US007784617B2

(12) United States Patent
Urban

(10) Patent No.: US 7,784,617 B2
(45) Date of Patent: Aug. 31, 2010

(54) OPEN-TOP AND OPEN-FRONT DISPLAY CARTON

(75) Inventor: Mark Francis Urban, Villa Hills, KY (US)

(73) Assignee: Sonoco Development, Inc., Hartsville, SC (US)

( * ) Notice: Subject to any disclaimer, the term of this patent is extended or adjusted under 35 U.S.C. 154(b) by 120 days.

(21) Appl. No.: 12/138,496

(22) Filed: Jun. 13, 2008

(65) Prior Publication Data

US 2009/0308786 A1 Dec. 17, 2009

(51) Int. Cl.
*B65D 1/22* (2006.01)

(52) U.S. Cl. ..... 206/750; 206/45.25; 206/736

(58) Field of Classification Search ..... 206/750, 206/756, 45.21, 45.25, 45.29, 297, 299, 721, 206/728, 395, 216; 211/50; 229/101, 71, 229/104

See application file for complete search history.

(56) References Cited

U.S. PATENT DOCUMENTS

| | | | | |
|---|---|---|---|---|
| 1,448,743 | A * | 3/1923 | Francis | 206/45.25 |
| 1,911,995 | A * | 5/1933 | Gaffney | 206/745 |
| 2,294,641 | A | 9/1942 | Walters | |
| 2,294,965 | A | 9/1942 | Davidson | |
| 4,128,167 | A * | 12/1978 | Hogshead, III | 206/45.29 |
| 4,138,012 | A | 2/1979 | Dutcher et al. | |
| 4,433,778 | A | 2/1984 | Maio et al. | |
| 4,951,813 | A | 8/1990 | Sauter | |
| 5,305,875 | A | 4/1994 | Meyer | |
| 5,344,004 | A | 9/1994 | Meyer | |
| 5,542,551 | A | 8/1996 | Smith | |
| D385,581 | S | 10/1997 | Linz | |
| D394,966 | S | 6/1998 | Connor et al. | |
| 5,862,980 | A | 1/1999 | Samuelson | |
| 6,186,343 | B1 | 2/2001 | Brown | |
| 6,227,438 | B1 * | 5/2001 | Hiltke | 229/101 |
| 6,886,737 | B2 * | 5/2005 | Dye | 229/102.5 |
| D509,729 | S | 9/2005 | Proudfit | |
| 2002/0088848 | A1 | 7/2002 | Harris et al. | |
| 2003/0066781 | A1 | 4/2003 | Ovadia | |
| 2005/0218092 | A1 | 10/2005 | Rosen | |
| 2008/0053867 | A1 | 3/2008 | Robbins | |

* cited by examiner

*Primary Examiner*—Mickey Yu
*Assistant Examiner*—Rafael Ortiz
(74) *Attorney, Agent, or Firm*—Alston & Bird LLP

(57) ABSTRACT

A display carton for products is described that is open at the top and front and that has an inclined floor panel, and that does not include any further bottom wall beyond the inclined floor panel. The carton includes a front panel joined to the front edge of the floor panel and extending downwardly therefrom to engage a support surface on which the carton is supported, a rear panel joined to the rear edge of the floor panel and extending upwardly therefrom, and a pair of side panel assemblies respectively located proximate opposite side edges of the floor panel. Each side panel assembly has an upper portion that extends upwardly from the respective side edge of the floor panel and a lower portion that extends downwardly from the respective side edge of the floor panel to engage the support surface.

18 Claims, 7 Drawing Sheets

OPEN-TOP AND OPEN-FRONT DISPLAY CARTON

BACKGROUND OF THE INVENTION

The present disclosure relates generally to display cartons for containing and displaying products such as in a retail establishment. The present disclosure relates more particularly to an open-top, open-front display carton of the type that frequently is shipped to the retailer pre-loaded with products such that it is merely necessary for the retailer to remove the carton from the shipping container and set the carton on a store shelf.

Because of the speed and ease with which such a display carton can be set up in a retail establishment, a carton of this type is sometimes called a "PDQ". A common placement for a PDQ is on an end cap at the end of a store aisle. In this usage, the display carton is often relatively wide (in the left-to-right direction) in comparison to its height and depth dimensions. For instance, an exemplary size for a PDQ for an end cap is about 30 inches wide by 14 inches deep (front-to-rear) by 10 or 11 inches high.

In the case of products that have a small base in relation to their height, the products tend to topple over easily. To prevent the products from toppling forward out of a display carton, it is known to incline the floor panel of the carton so that the products are tilted rearwardly toward the rear panel. In many display cartons having an inclined floor panel, the carton also has an additional horizontal bottom wall lying beneath the inclined floor panel. The bottom wall provides the carton with the rigidity needed when shipping the carton, and also forms the base on which the carton is supported on a store shelf.

BRIEF SUMMARY OF THE DISCLOSURE

The present disclosure is directed to a display carton such as a PDQ that is open at the top and front and that has an inclined floor panel. The display carton is "bottomless" in that it does not include any further bottom wall beyond the inclined floor panel. This design saves considerably on total material usage. At the same time, the display carton's construction provides substantial rigidity despite the lack of an additional bottom wall.

In accordance with one embodiment of the invention, the open-top, open-front display carton comprises a floor panel inclined upwardly from a rear edge to a front edge of the floor panel, a front panel joined to the front edge of the floor panel and extending downwardly therefrom to engage a support surface on which the carton is supported, a rear panel joined to the rear edge of the floor panel and extending upwardly therefrom, and a pair of side panel assemblies respectively located proximate opposite side edges of the floor panel. Each side panel assembly has an upper portion that extends upwardly from the respective side edge of the floor panel and a lower portion that extends downwardly from the respective side edge of the floor panel to engage the support surface.

Thus, the display carton is supported on all four sides, by the rear edge of the floor panel, the lower edge of the front panel, and the lower edges of the side panel assemblies.

In one embodiment, each side panel assembly includes an inner side panel integrally connected to either the floor panel along a fold line at the respective side edge of the floor panel or to the rear panel along a fold line at the respective side edge of the rear panel. Each side panel assembly further includes an outer side panel integrally connected (either directly or via an intermediate top panel) to the respective inner side panel along a fold line. The outer side panels are folded outwardly (away from each other) to extend downwardly and outwardly of the inner side panels. The outer side panels form the lower portions of the side panel assemblies that engage the support surface.

In one embodiment, the front panel is integrally connected to the front edge of the floor panel along a fold line therebetween. The front panel can comprise an outer front panel connected to the floor panel along the fold line, and an inner front panel integrally connected along a fold line to a lower edge of the outer front panel. The inner front panel is folded inwardly and upwardly so that it lies against an inwardly facing surface of the outer front panel. An upper edge of the inner front panel defines one or more tabs that fit into one or more slots in the floor panel to lock the inner front panel (and therefore the outer front panel, as well) in place.

In one embodiment, each side panel assembly includes a tab that is engaged between the inner front panel and the outer front panel. The tabs can project from front edges of the outer side panels.

In one embodiment, the display carton is formed as a fold-and-lock carton from a one-piece sheet defining a plurality of panels that are folded relative to one another and locked into position by inter-engagement of locking elements formed in the sheet.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

DETAILED DESCRIPTION OF THE DRAWINGS

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1A:
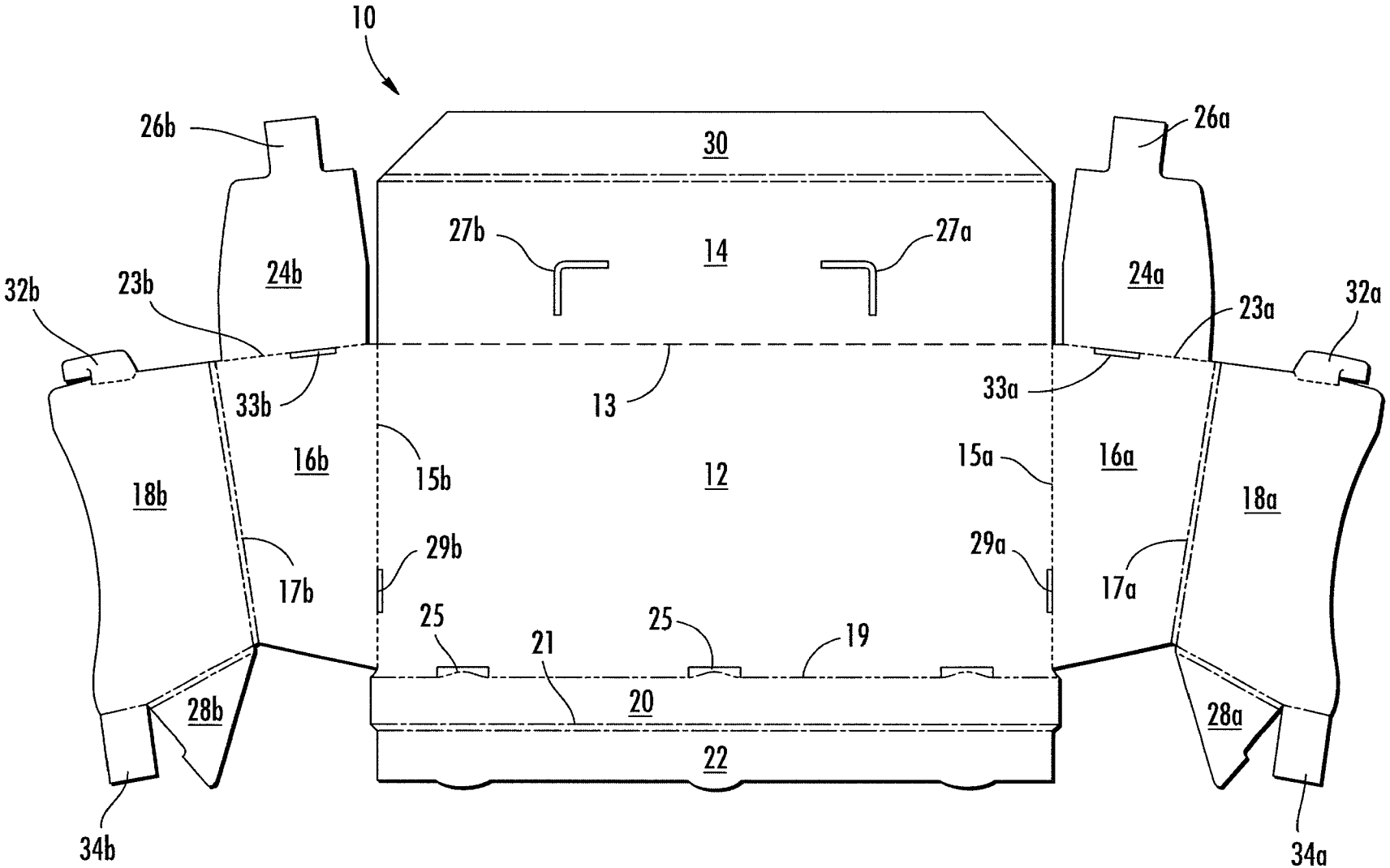
FIG. 1A is a plan view of a blank for making a display carton in accordance with one embodiment of the invention.
Figure 2:
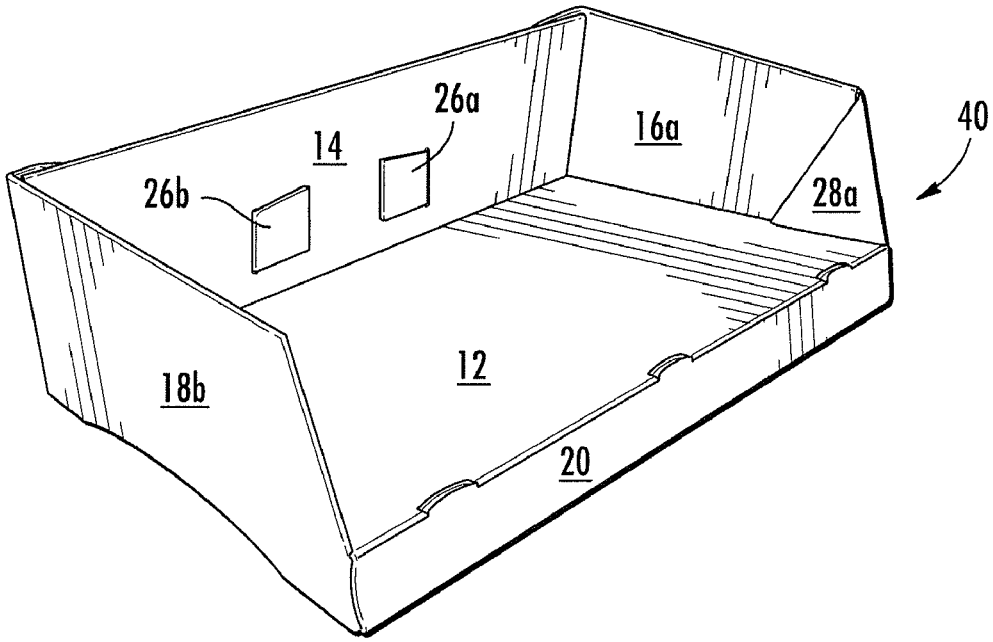
FIG. 2 is a perspective view of a display carton made from the blank of FIG. 1A.
Figure 3:
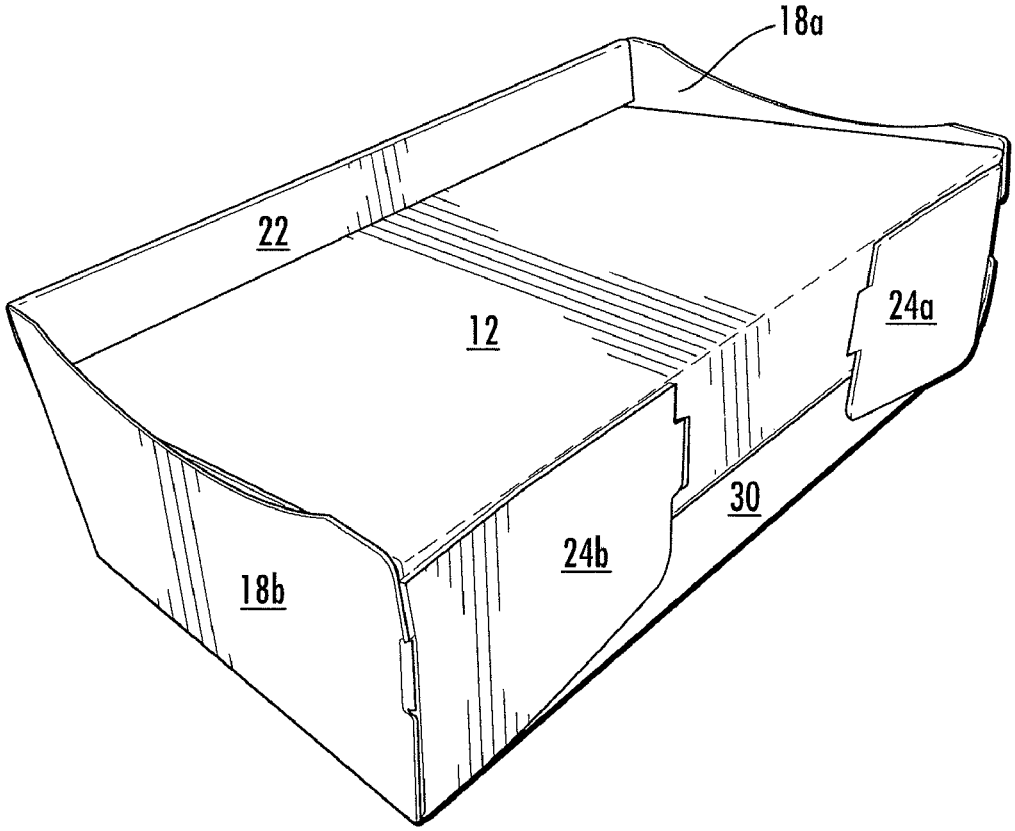
FIG. 3 is a perspective view of the bottom of the display carton of FIG. 2.

A blank 10 for making an open-top, open-front display carton in accordance with one embodiment of the invention is depicted in FIG. 1A. Perspective views of the display carton 40 erected from the blank 10 are shown in FIGS. 2 and 3. The blank 10 is formed by die-cutting a sheet of rigid or semi-rigid material and forming fold lines in predetermined locations to facilitate folding the various panels of the blank relative to one another. The blank includes a generally rectangular floor panel 12 having a rear edge defined by a fold line 13 between the floor panel and a generally rectangular rear panel 14, and having a front edge defined by a fold line 19 between the floor panel and a generally rectangular outer front panel 20. An inner front panel 22 is connected along a fold line 21 to a front edge of the outer front panel 20. A fold-down panel 30 is connected to an upper edge of the rear panel 14.

A first side edge of the floor panel 12 is connected along a fold line 15*a* to a first inner side panel 16*a*, which in turn is connected along a fold line 17*a* to a first outer side panel 18*a*. Similarly, a second side edge of the floor panel is connected along a fold line 15*b* to a second inner side panel 16*b*, which in turn is connected along a fold line 17*b* to a second outer side panel 18*b*. The rear edge of the first inner side panel 16*a* is connected along a fold line 23*a* to a first rear locking panel 24*a*, which defines a tab 26*a* at an edge of the panel opposite from the fold line 23*a*. Similarly, the rear edge of the second inner side panel 16*b* is connected along a fold line 23*b* to a second rear locking panel 24*b*, which defines a tab 26*b*. The inner and outer side panels 16*a*, 18*a* form a first side panel assembly, and the inner and outer side panels 16*b*, 18*b* form a second side panel assembly.

A front edge of the first outer side panel 18*a* is connected to a front locking panel 28*a* and a tab 34*a*; similarly, a front edge of the second outer side panel 18*b* is connected to a front locking panel 28*b* and a tab 34*b*. The rear edges of the outer side panels 18*a,b* are respectively connected to tabs 32*a,b*.

Figure 1B:
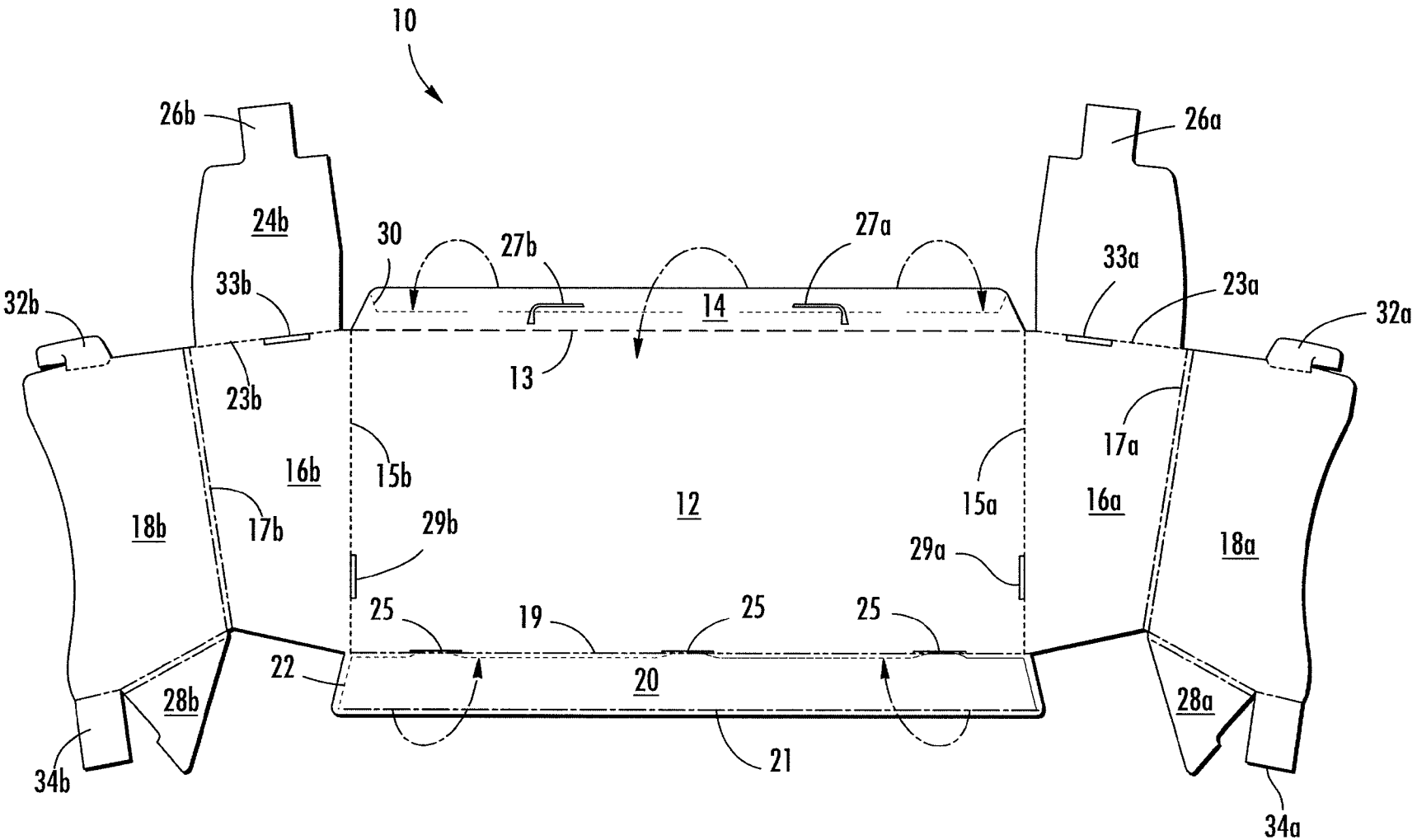
FIG. 1B is a view generally similar to FIG. 1A, showing the rear and front panels being folded relative to the floor panel in order to erect the display carton.

With reference to FIG. 1B, to erect the carton 40 from the blank 10, the rear panel 14 is folded upwardly approximately 90° about the fold line 13 and the fold-down panel 30 on the rear panel 14 is folded outwardly and downwardly. The outer front panel 20 is folded downwardly approximately 90° about the fold line 19. The inner front panel 22 is folded inwardly and upwardly about the fold line 21 so it lies flush against the inner surface of the outer front panel 20, and tabs on the inner front panel 22 are engaged in slots 25 defined at the front edge of the floor panel 12.

Figure 1C:
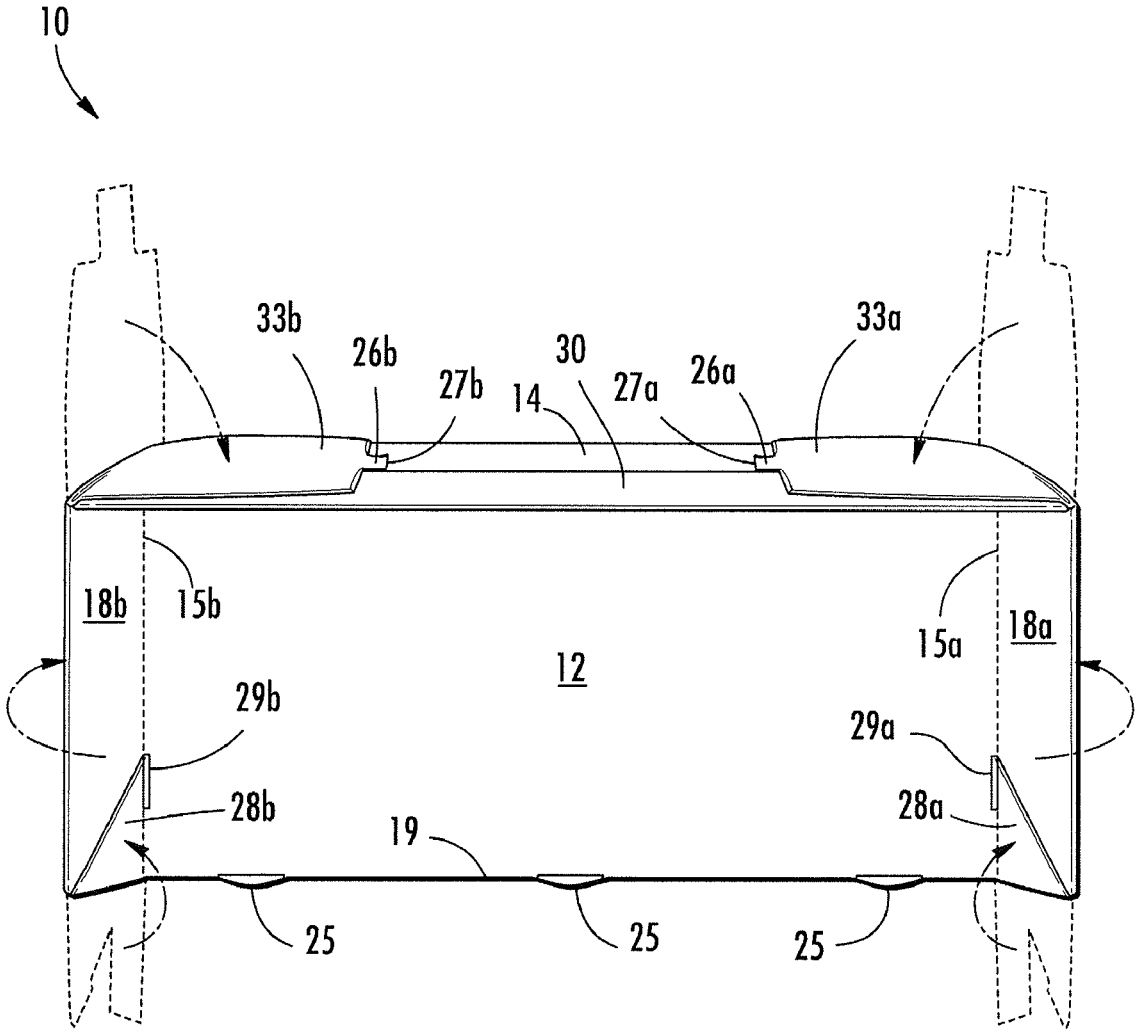
FIG. 1C shows further steps in the erection of the display carton from the blank.

As depicted in FIG. 1C, the inner side panels 16*a,b* are folded upwardly approximately 90° about the fold lines 15*a, b*, and the outer side panels 18*a,b* are folded outwardly and downwardly about the fold lines 17*a,b* so that they lie against the outer surfaces of the inner side panels 16*a,b*. The rear locking panels 24*a,b* are folded inwardly about the fold lines 23*a,b* and the tabs 26*a,b* are respectively inserted into slots 27*a,b* defined in the rear panel 14 to lock the panels in place. The fold-down panel 30 on the rear panel 14 is folded outwardly and downwardly and is engaged between the rear panel and the locking panels 24*a,b*.

The tabs 32*a,b* on the outer side panels are respectively inserted into slots 33*a,b* disposed at the rear edges of the inner side panels 16*a,b* to help lock the outer side panels in place. The front locking panels 28*a,b* on the outer side panels 18*a,b* are folded inwardly to lie against the inner surfaces of the inner side panels 16*a,b*, and tabs on the front locking panels 28*a,b* are respectively engaged in slots 29*a,b* defined at the side edges of the floor panel 12 to further lock the outer and inner side panels in place. The tabs 34*a,b* on the outer side panels 18*a,b* are engaged between the outer and inner front panels 20, 22.

The carton 40 can be quickly and easily erected from the blank. Once erected, the carton can be pre-loaded with products and placed into a shipping container (possibly along with one or more additional pre-loaded cartons 40) for shipping to the retailer. The retailer can simply open the shipping container, remove the pre-loaded carton 40, and set it on a store shelf.

By virtue of the inclined floor panel 12 of the carton, products displayed in the carton are tipped rearwardly toward the rear panel 14 so they are discouraged from toppling forward out of the carton. Another significant aspect of the display carton is the fact that the outer side panels 18*a,b* have lower edges that are disposed below (i.e., at a lower vertical level than) the floor panel 12 to engage the support surface. This provides additional support for the carton and is a significant part of the reason why the carton can be made in a large size (e.g., 30"×14"×10.5") and still have sufficient rigidity to maintain its shape and integrity when fully loaded with products. Furthermore, because of the design of the side panel assemblies, the front panel assembly 20, 22 is not solely responsible for supporting the floor panel 12 in the inclined orientation; indeed, the front panel assembly can be entirely omitted, if desired.

The carton 40 can be formed from various materials. Suitable materials include corrugated cardboard, corrugated plastic, and any other sheet material having sufficient rigidity as well as foldability.

In the illustrated display carton 40, the outer side panels 18*a,b* have lower edges each of which includes a medial portion shaped generally like a circular arc. These medial portions of the lower edges do not contact the support surface, so that a person can insert his or her fingers in the resulting clearances and readily grasp and pick up the carton. Alternatively, however, the lower edges of the outer side panels could be straight such that they contact the support surface without any substantial clearances therebetween.

As one example of a display carton in accordance with the invention, the floor panel 12 can have a width of about 29.5 inches and a depth of about 14 inches. The rear panel 14 and outer side panels 18*a,b* can have a height of about 7 to 7.5 inches. The front panel 20 can have a height of about 2.5 inches. The floor panel 12 is inclined at an angle of about 10° relative to a support surface on which the carton is supported.

The dimensions of the carton noted above are only exemplary and are not limiting in any way. Based on the present disclosure, persons of ordinary skill in the art would understand how to modify the dimensions of the panels in various ways to alter the overall shape and size of the carton, and would understand that the particular locking features shown and described herein are not the only way to lock the panels in place, but can be replaced with other locking arrangements.

Although the carton 40 described herein is a fold-and-lock type of carton, the principles of the present invention can be applied to other carton types such as fold-and-glue cartons.

Figure 4:
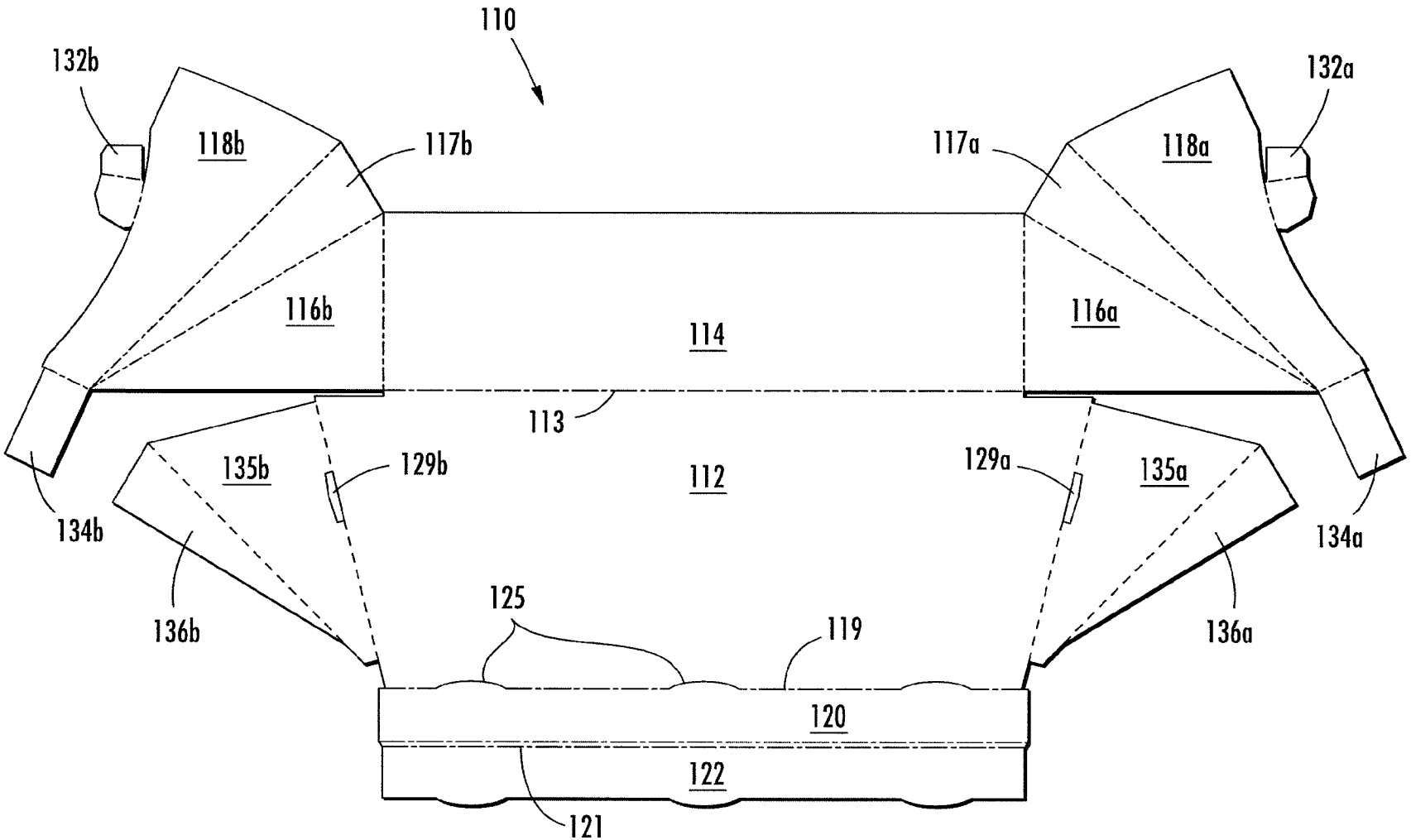
FIG. 4 is a plan view of a blank for making a display carton in accordance with another embodiment of the invention.
Figure 5:
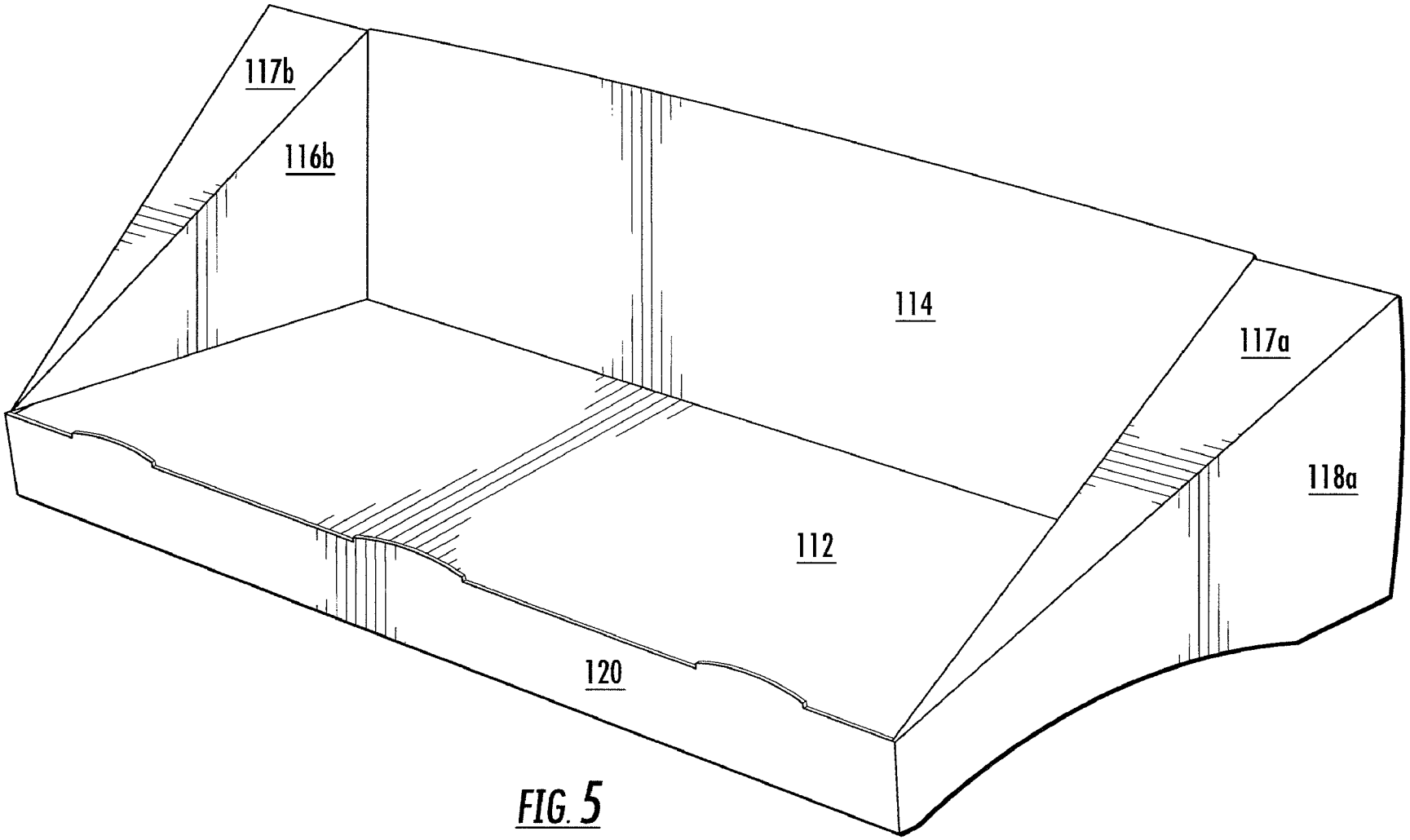
FIG. 5 is a perspective view of a display carton made from the blank of FIG. 4.
Figure 6:
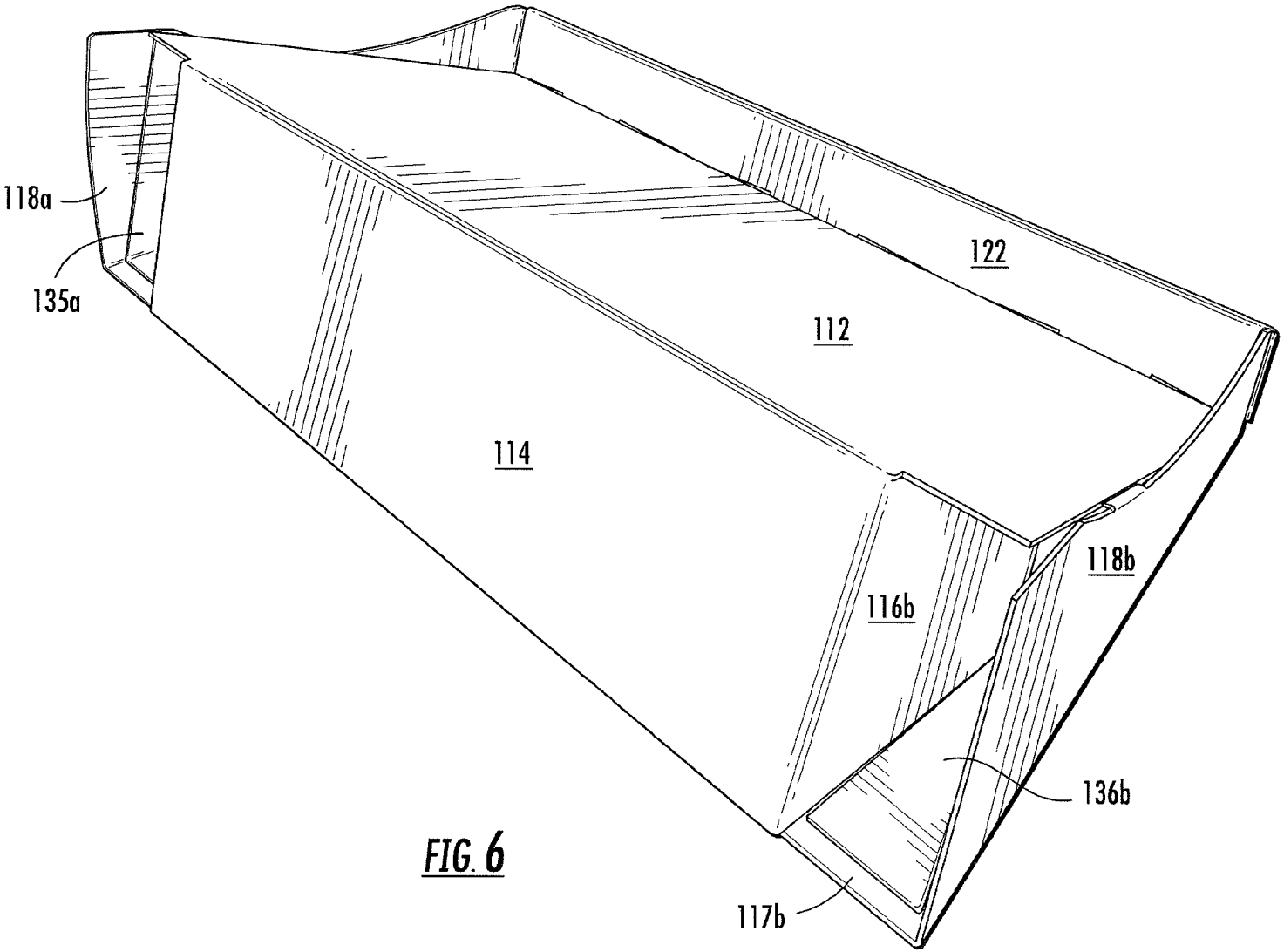
FIG. 6 is a perspective view of the bottom of the display carton of FIG. 5.

A second embodiment of the invention is illustrated in FIGS. 4 through 6. FIG. 4 shows a blank 110, and FIGS. 5 and 6 show a carton 140 erected from the blank 110. The blank 110 is similar in many respects to the blank 10 of FIG. 1A. The blank 110 includes a generally rectangular floor panel 112 having a rear edge defined by a fold line 113 between the floor panel and a generally rectangular rear panel 114, and having a front edge defined by a fold line 119 between the floor panel and a generally rectangular outer front panel 120. An inner front panel 122 is connected along a fold line 121 to a front edge of the outer front panel 120.

While the side panel assemblies in the first embodiment are connected to the opposite edges of the floor panel, in the second embodiment the side panel assemblies are connected to opposite side edges of the rear panel 114. Thus, the blank includes a first inner side panel 116*a* connected along a fold line to a first side edge of the rear panel 114, and a corresponding second inner side panel 116*b* connected along a fold line to an opposite second side edge of the rear panel 114. The side panel assemblies are configured such that they are tapered in height from the rear to the front of the display carton. Thus, the inner side panels 116*a,b* have a maximum height at their rear edges where they connect to the rear panel 114, and a minimum height at their opposite front edges. The upper edge of the first inner side panel 116*a* is connected along a fold line to a first top panel 117*a*, and similarly the second inner side panel 116*b* is connected along a fold line to a second top panel 117*b*. The opposite edge of the first top panel 117*a* is connected along a fold line to a first outer side panel 118*a*; similarly, the opposite edge of the second top panel 117*b* is connected along a fold line to a second outer side panel 118*b*.

The outer edge (which becomes the lower edge, when the carton is erected) of the first outer side panel 118*a* is connected to a tab 132*a*, and the outer/lower edge of the second outer side panel 118*b* is connected to a tab 132*b*. The front edge of the first outer side panel 118*a* is connected to a tab 134*a*, and the front edge of the second outer side panel 118*b* is connected to a tab 134*b*.

A first intermediate side panel 135*a* is connected along a fold line to a first side edge of the floor panel 112. The opposite edge of the first intermediate side panel 135*a* is connected along a fold line to a panel 136*a*. Similarly, a second intermediate side panel 135*b* is connected along a fold line to a second side edge of the floor panel 112. The opposite edge of the second intermediate side panel 135*b* is connected along a fold line to a panel 136*b*.

To erect the carton 140 (FIGS. 5 and 6) from the blank 110, the rear panel 114 is folded upwardly approximately 90° about the fold line 113. The outer front panel 120 is folded downwardly approximately 90° about the fold line 119. The inner front panel 122 is folded inwardly and upwardly about the fold line 121 so it lies flush against the inner surface of the outer front panel 120, and tabs on the inner front panel 122 are engaged in slots 125 defined at the front edge of the floor panel 112.

The inner side panels 116*a,b* are folded inwardly approximately 90° about the fold lines where they connect to the rear panel 114. The intermediate side panels 135*a,b* are folded upwardly approximately 90° about the fold lines where they connect to the floor panel 112. The panels 136*a,b* are folded inwardly approximately 90° about the fold lines where they connect to the intermediate side panels 135*a,b*.

Next, the top panels 117*a,b* are folded outwardly approximately 90° about the fold lines where they connect to the inner side panels 116*a,b*. The outer side panels 118*a,b* are folded downwardly approximately 90° about the fold lines where they connect to the top panels 117*a,b*. The tabs 132*a,b* are respectively inserted into slots 129*a,b* formed in the intermediate side panels 135*a,b* adjacent their fold lines with the floor panel. The tabs 134*a,b* are inserted between the outer and inner front panels 122, 120.

In the erected carton 140, as best seen in FIG. 5, the side panel assemblies (made up of the inner side panels 116*a,b*, top panels 117*a,b*, and outer side panels 118*a,b*) form tapered or sloping walls that decrease in height in the rear-to-front direction, reaching essentially zero height at the front of the carton. The lower edges of the outer side panels 118*a,b* (or at least portions of the lower edges proximate the front of the carton) extend to a lower vertical level than the side edges of the floor panel 112 to engage the support surface, similar to the first embodiment.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An open-top, open-front display carton for products, comprising:

a floor panel inclined upwardly from a rear edge to a front edge of the floor panel;

a front panel joined to the front edge of the floor panel and extending downwardly therefrom to engage a support surface on which the carton is supported;

a rear panel joined to the rear edge of the floor panel and extending upwardly therefrom; and a pair of side panel assemblies respectively located proximate opposite side edges of the floor panel, each side panel assembly including an inner side panel having an upper portion that extends upwardly from the respective side edge of the floor panel, and including an outer side panel having a lower portion that extends downwardly from the respective side edge of the floor panel and terminates at a lower edge at least a portion of which is located at a lower vertical level than the respective side edge of the floor panel so as to engage the support surface.

2. The open-top, open-front display carton of claim 1, wherein the carton is free of any other bottom wall besides the floor panel.

3. The open-top, open-front display carton of claim 1, wherein the inner side panels are integrally connected along fold lines to the opposite side edges of the floor panel, and the outer side panels are integrally connected along fold lines to upper edges of the inner side panels.

4. The open-top, open-front display carton of claim 3, wherein each side panel assembly includes a rear locking panel that is folded inwardly and extends generally parallel to the rear panel and has a locking portion engaged in a slot defined in the rear panel.

5. The open-top, open-front display carton of claim 3, wherein each side panel assembly includes a front locking panel that is folded inwardly and extends generally parallel to the respective side panel assembly and has a locking portion engaged in a slot defined in the floor panel.

6. The open-top, open-front display carton of claim 1, wherein the inner side panels are integrally connected along fold lines to opposite side edges of the rear panel.

7. The open-top, open-front display carton of claim 6, further comprising a pair of top panels each respectively connected along a fold line to an upper edge of the respective inner side panel, and wherein the outer side panels are respectively connected along fold lines to opposite edges of the top panels.

8. The open-top, open-front display carton of claim 7, further comprising a pair of intermediate side panels respectively connected along fold lines to opposite side edges of the floor panel and extending upwardly therefrom, the intermediate side panels being disposed between the inner side panels and the outer side panels.

9. The open-top, open-front display carton of claim 8, further comprising a pair of tabs respectively connected to lower edges of the outer side panels, the tabs being respectively engaged in slots defined in the intermediate side panels adjacent the fold lines with the floor panel.

10. The open-top, open-front display carton of claim 1, wherein the front panel is integrally connected to the front edge of the floor panel along a fold line therebetween.

11. The open-top, open-front display carton of claim 10, wherein the front panel comprises an outer front panel connected to the floor panel along the fold line, and an inner front panel integrally connected along a fold line to a lower edge of the outer front panel, the inner front panel lying against an inwardly facing surface of the outer front panel.

12. The open-top, open-front display carton of claim 11, wherein an upper edge of the inner front panel defines one or more tabs that fit into one or more slots in the floor panel to lock the inner front panel in place.

13. The open-top, open-front display carton of claim 11, wherein each side panel assembly includes a tab that is engaged between the inner front panel and the outer front panel.

14. An open-top, open-front, fold-and-lock display carton for products, comprising:

a one-piece sheet defining a plurality of panels that are folded relative to one another and locked into position by inter-engagement of locking elements formed in the sheet, wherein the plurality of panels include:

a floor panel having a front edge, a rear edge, and a pair of opposite side edges;

a rear panel joined to the rear edge of the floor panel and extending upwardly therefrom;

a front panel joined to the front edge of the floor panel and extending downwardly therefrom, the front panel defining a lower edge;

a pair of inner side panels respectively located proximate the side edges of the floor panel and extending upwardly therefrom, the inner side panels defining inner surfaces facing each other and outer surfaces facing away from each other; and a pair of outer side panels respectively joined to upper edges of the inner side panels and extending downwardly therefrom and outward of the outer surfaces of the inner side panels and each terminating at a lower edge at least a portion of which is located at a lower vertical level than the respective side edge of the floor panel;

the lower edges of the front panel and outer side panels and the rear edge of the floor panel all engaging a support surface on which the carton is supported such that the floor panel is inclined upwardly from the rear edge to the front edge thereof.

15. The open-top, open-front, fold-and-lock display carton of claim 14, wherein the carton is free of any other bottom wall besides the floor panel.

16. The open-top, open-front display carton of claim 14, wherein the front panel comprises an outer front panel connected to the front edge of the floor panel along a fold line, and an inner front panel integrally connected along a fold line to a lower edge of the outer front panel, the inner front panel lying against an inwardly facing surface of the outer front panel.

17. The open-top, open-front display carton of claim 16, wherein an upper edge of the inner front panel defines one or more tabs that fit into one or more slots in the floor panel to lock the inner front panel in place.

18. The open-top, open-front display carton of claim 14, wherein each outer side panel includes a tab extending from a front edge of the outer side panel and engaged between the inner front panel and the outer front panel.

* * * * *